United States Patent [19]

Breslow

[11] 3,949,986

[45] Apr. 13, 1976

[54] ROTATABLE CARD CARRYING GAME APPARATUS

[75] Inventor: Jeffrey D. Breslow, Highland Park, Ill.

[73] Assignee: Marvin Glass & Associates, Chicago, Ill.

[22] Filed: Feb. 13, 1975

[21] Appl. No.: 549,699

[52] U.S. Cl. ..... 273/1 R; 273/143 R; 40/68.4

[51] Int. Cl.[2] ..... A63G 31/02

[58] Field of Search ..... 273/143 C, 1 R, 142 R, 273/142 JC, 138 R; 40/68.4

[56] References Cited

UNITED STATES PATENTS

| | | | |
|---|---|---|---|
| 802,782 | 10/1905 | Porter et al. | 273/142 JC |
| 807,927 | 12/1905 | Henwood | 273/143 C |
| 2,500,830 | 3/1950 | Jones | 273/142 R |
| 3,103,080 | 9/1963 | Desmond | 273/142 R |
| 3,841,637 | 10/1974 | Piazza et al. | 273/142 R |

*Primary Examiner*—Richard C. Pinkham
*Assistant Examiner*—William R. Browne
*Attorney, Agent, or Firm*—Coffee & Sweeney

[57] ABSTRACT

A game apparatus which includes a set of playing cards and a card displaying device for permitting sequential visual observance of one or more of the playing cards by the players of the game for only a predetermined period of time. The displaying device includes a central rotatable drum portion which is surrounded by a stationary base portion which substantially conceals a vertical cylindrical wall portion of the drum. A vertical slot or aperture is provided in the upstanding wall of the base portion so that as the drum rotates relative to the base a portion of the cylindrical wall of the drum is visible within the aperture. A plurality of card holding pockets are provided in the cylindrical wall portion of the drum to support the playing cards which may then be viewed as each pocket moves past the vertical aperture in the base wall. During the play of the game, the aperture is positioned to be visible to only one of the players of the game, and that player accumulates points as he attempts to convey the image carried by the card to one or more of the other players of the game by non-verbal communication, such as sign language or other dramatic action.

7 Claims, 6 Drawing Figures

Fig 1
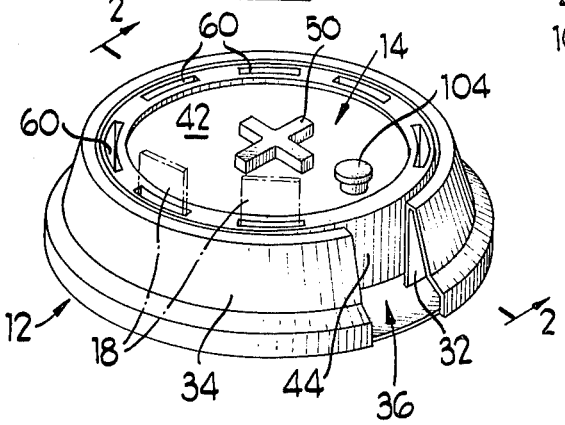
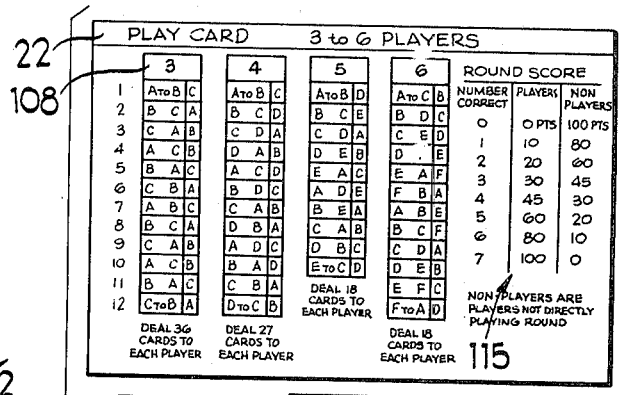
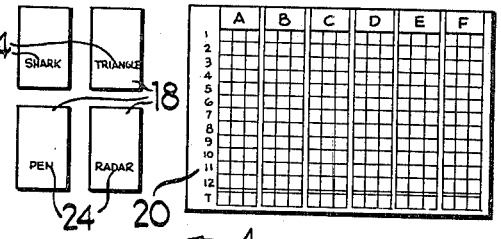
Fig 6
Fig 2
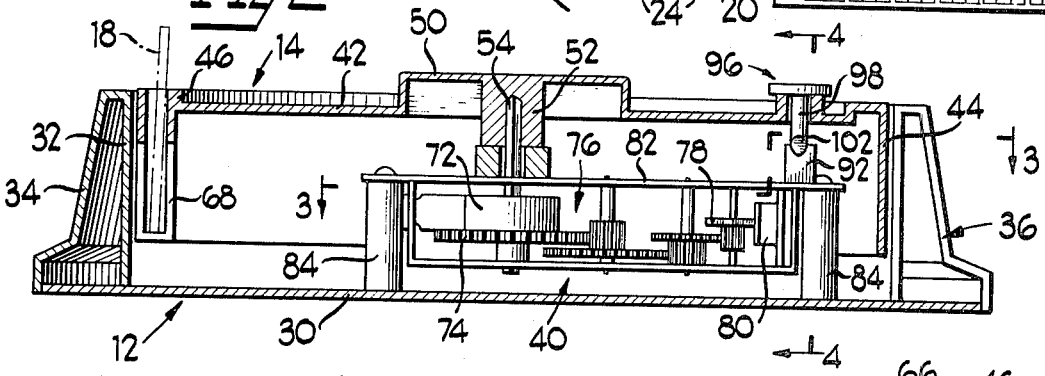
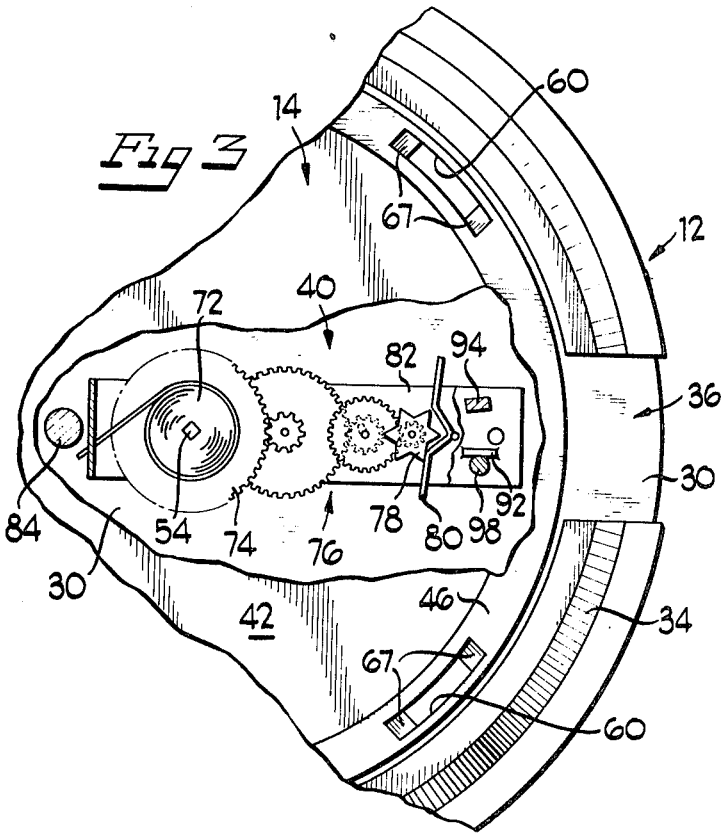
Fig 3
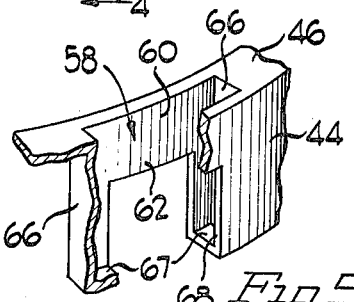
Fig 5
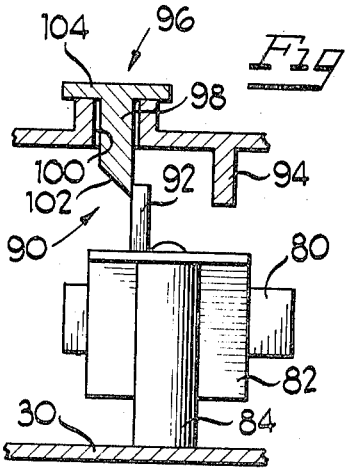
Fig 4

ROTATABLE CARD CARRYING GAME APPARATUS

BACKGROUND AND SUMMARY OF THE INVENTION

This invention relates to game devices, and more particularly to a new and improved game of the type wherein the components of the game are used to facilitate one of the players in attempting to communicate a message to at least one of the other players of the game by non-verbal signals.

Guessing games in which one player tries to convey a word or message to other players by dramatic action or sign language have been well received by the public. One particular game of this type is the game of charades wherein two teams compete against a clock whereby one of the players of each team tries to convey a message to the remainder of the players on his team. However, when playing a game of charades, it is necessary to have a minimum of two players on each team and is even more desirable to have several players on each team to provide a faster and more competitive game. The game apparatus of the present invention permits the playing of a charade-type game with a small number of people, for example, between three and six persons. The game apparatus permits a game to be played by fewer players by directing and alternating partners with one another during the play of the game in using the game apparatus.

The game apparatus includes a stationary base having an upstanding cylindrical wall portion thereabout which is interrupted at one point to provide a vertical aperture therethrough. A rotatable drum is mounted interiorly on the base so that a cylindrical wall portion of the drum is adjacent the wall of the base to permit viewing of a portion of the drum wall through the aperture. A plurality of pockets are provided about the periphery of the drum wall for inserting and supporting cards from a deck thereof to permit sequential viewing of indicia on the cards by one of the players of the game through the aperture as the drum rotates. Drive means is mounted on the base to rotate the drum so that the cards carrying indicia slowly pass the aperture so that each card may be viewed by one of the players for a predetermined period of time during which that player attempts to convey a message by non-verbal signals in an attempt to have another player identify the indicia on the particular card. After one complete revolution of the drum, the rotation is stopped signifying the end of that round of the game.

Other objects, features and advantages of the invention will be apparent from the following detailed description taken in connection with the accompanying drawings.

BRIEF DESCRIPTION OF THE DRAWINGS

FIG. 1 is a perspective view of the display means of the game apparatus of the present invention;

FIG. 2 is a vertical section, on an enlarged scale, of the display means, taken generally along the line 2—2 of FIG. 1;

FIG. 3 is a fragmented horizontal section of the display means, taken generally along the line 3—3 of FIG. 2;

FIG. 4 is a vertical section, on an enlarged scale, of the stop means, taken generally along the line 4—4 of FIG. 2;

FIG. 5 is a fragmented perspective view showing one of the card holding pockets of the display means of the present invention; and FIG. 6 is a perspective view of some of the playing cards, score cards and a player matching card of the present invention.

DESCRIPTION OF THE PREFERRED EMBODIMENT

The game apparatus of the present invention includes display means or a display device, generally designated 10 (FIG. 1), which has a generally cylindrical outer base portion, generally designated 12, and an inner rotatable drum portion, generally designated 14. Referring to FIG. 6, the game apparatus also includes a plurality of playing cards 18, a score card 20 and a player matching card 22. The playing cards 18 each include indicia 24 thereon which provides a message to one of the players of the game. The player matching card 22 provides instructions for use during the play of the game to match the various players into pairs so as to equalize the probability and the opportunity of each player to win the game, as will be described in greater detail hereinafter.

The object of the game is for one of the players to convey a word or message from one of the cards 18 to another player of the game for identification by means of non-verbal signals or dramatic action. In this respect, the game apparatus 10 provides means for playing the game commonly known as charades.

The display device 10 permits viewing of the indicia 24 on the cards 18 one at a time by only one of the players of the game. More particularly, referring to FIG. 2, the display device 10 includes the rotatable drum portion 14 and the stationary base portion 12. The base 12 includes a circular or disc-shaped plate 30 having a generally vertical cylindrical wall 32 thereabout. The vertical wall 32 is supported by and formed integrally with an outside support wall 34, the shape of which can be varied according to preference and molding technique. The vertical wall 32 and the support wall 34 are interrupted at one point to form an aperture 36 therebetween.

The rotatable drum 14 is mounted on the base 12 by a drive means, generally designated 40 (FIGS. 2 and 3), which is mounted on the base plate 30 which is described in detail hereinafter. The rotatable drum 14 includes an upper disc portion 42 which is circumscribed by a depending cylindrical flange 44. The flange 44 is mounted to the disc around its circumference by an offset upper annular wall 46. A cross or hand crank 50, for winding the drive means, is centrally disposed on the disc 42 and includes a depending axle journal 52 for engagement with a square output shaft 54 of the drive means 30.

Referring now to FIGS. 1 and 5, a plurality of pockets, generally designated 58, are provided in the cylindrical flange 44 for supporting the card 18, as shown by the phantom lines in FIGS. 1 and 2. Each pocket 58 is mounted below an aperture 60 (FIG. 1) formed in the annular wall 46. Each pocket 58 is formed below an aperture 60 by an internal wall 62, two side walls 66, a bottom wall 67 and the cylindrical wall 44. The cylindrical wall 44 includes a cutout portion or aperture 68 near the lowermost end of the pocket 58 so that, when a playing card 18 is positioned within the pocket 58 the indicia 24 thereon can be viewed through the aperture 68 when aligned therewith. Referring to FIG. 1, it now can be seen that the indicia 24 on one of the playing cards 18 would be visible through one of the apertures 68, and the aperture 36 provided in the base wall 32, as the drum 14 rotates relative to the base.

The drive means 40 rotates the drum portion 14 one revolution so that each card 18 will become visible for a given period of time within the aperture 36. More particularly, the drive means 40 includes a spirally wound coil spring 72 which is fixed to one gear 74 of a gear train, generally designated 76, which is in mesh with a starwheel 78. The rotation of the starwheel is limited or governed by an engaging oscillating governor leaf 80. The square output shaft 54 is fixed for rotation with the gear 74 and coil spring 72 and extends upwardly into the journal 52 for driving the drum 14. The drive means is mounted within a sheet metal frame 82 (FIGS. 2 and 3) which is mounted to the base plate 30 by a pair of upstanding posts 84.

During the play of the game, it is desirable that the drum 14 make only one revolution which will permit sequential viewing of the indicia on all of the cards 18 within the pockets 58. To this end, stop means, generally designated 90 (FIG. 4), is provided to permit only one revolution of the drum 14 during the play of the game and to prevent accidental overwinding of the coil spring 72. More particularly, referring to FIG. 4, the stop means 90 includes an upstanding flange or tab 92 mounted on the drive means frame 82. The upper disc 42 of the drum 14 includes a depending tab 94 which will engage the tab 92 during the winding process and prevent overwinding of the coil spring 72. A latch 96 also is provided on the disc 42 in a clockwise direction from the tab 94 for holding the drum 14 in the wound or cocked position. The latch 96 includes a reciprocating shaft 98 which is slidably mounted within a bossed aperture 100 formed in the disc 42. The lowermost surface of the shaft 98 is beveled, as at 102, so that during clockwise rotation or winding of the spring motor 72 the latch 96 will cam upwardly as the beveled edge 102 engages the tab 92 and immediately drops back down to prevent unwinding counterclockwise rotation of the drum until the players are ready to begin playing the game. A head 104 is provided on the top of the shaft 98 to facilitate manual movement of the latch 96 when it is desired to start the play of the game.

Referring now to FIG. 6, the player choice card 22 dictates the order in which the players of the game shall proceed and dictates which groups of players will form pairs during the play of the game. More particularly, the lefthand column 108, on the card 22, is designated for use when three players are playing the game. Each horizontal column or line designates which of the possible functions each of the players will perform. For example, in the first round of play, designated by the numeral 1, player A reads the indicia 24 on the cards as they appear in the aperture 36 and tries to convey the message to player B by sign language or dramatic action. In this case, player C's function is to position the cards 18 within the pockets 58. Likewise in the second round player B tries to convey the message by sign language to player C and player A places the cards within the pockets 58. The remaining column headed by the numerals 4, 5 and 6 are used when the game is being played by that particular number of players, respectively. In this manner, the probabilities are equalized since, in most cases, each player has had an opportunity to convey the messages to each of the other players of the game and also has had an opportunity to stump the other players of the game with his choice of cards 18. Note that a different number of cards are dealt to each player at the beginning of the game depending upon how many players are participating, as indicated by the indicia on the bottom of each of the columns.

The three columns of indicia, generally designated 115, on the righthand portion of the card 22, contains the rules of the game for scoring. Assume that in our example, player A is attempting to transfer the message carried by the cards 18 to player B and that player C has placed the cards 18 within the pockets 58. Also, assume that after one round, or one revolution of the drum 14, players A and B have correctly identified five messages and missed the other two. Referring to the columns 115, the lefthand column represents the number of messages correctly identified by the pair, A and B. Reading down this column to five and then across to the middle and right-hand columns, the number of points which are to be awarded to each person can be read. In this example, a 60 in the middle column indicates that both player A and player B will receive 60 points. A 20 in the righthand column would indicate that player C, in our example, will be awarded 20 points. Any of the other players of the game, will not be awarded any points during this round of play since they did not participate.

Initially, in one scheme of play, each of the players is given a plurality of indicia cards 18 according to the rules as prescribed on the card 22. As designated by the card 22, two of the players participate in trying to transfer the message carried by the indicia 24 on the cards and one of the other players, if there are more than two players, will place seven of his cards 18 on the display device 10 by positioning one card within each of the pockets 58. The drum 14 then is allowed to rotate through one revolution which permits the player who is reading the cards through the aperture 36 to see the indicia 24 on the cards successively, for the period of time in which the card passes the aperture 36. Thereafter, the next card appears. At the end of the game, the scores are totalled on the scoring cards 20 and that player with the highest score is declared the winner of the game.

Of course, it is also contemplated that the play of the game be varied, for example, by using verbal communication in an attempt to convey a message. For example, the rules may be varied to permit the player attempting to communicate a message to another player to give verbal hints or clues which may be similar to the message but without actually repeating the indicia. Other variations and modifications of the rules of the game may be made without departing from the spirit of the invention.

The embodiment shown and described in the foregoing detailed description has been given for clearness of understanding and no unnecessary limitations should be understood therefrom as some modifications will be obvious to those skilled in the art.

What is claimed is:

1. A game apparatus, comprising:

a base including a peripheral side wall portion about which a plurality of players may position themselves, said base including a viewing area defined by a vertical slot in said side wall;

a plurality of substantially flat playing cards, at least some of which include indicia thereon;

card display means mounted on the base, said display means including card carrying means for rotatably and removably supporting at least one of said playing cards, said display means moving at least one card past the viewing area defined by said slot thereby exposing the face of a card in the card carrying means for only a limited period of time, during rotation, to one player of the game positioned in front of the viewing area but hiding the indicia on a card at the viewing area from another player not positioned in front of the viewing area so that one player may visually convey the message related by the indicia of a card in the viewing area to another player of the game during said limited period of time.

2. The game apparatus of claim 1 including drive means, having a spring motor, mounted on the base in a driving relationship with said movable portion to move said card carrying means past said viewing area.

3. The game apparatus of claim 1 wherein said base side wall portion is a generally upstanding cylindrical wall and said movable portion comprises a generally cylindrical drum rotatable within the upstanding cylindrical side wall portion of said base about a vertical axis, said drum including at least one pocket formed therein for receiving and supporting a card for movement past said aperture as the drum is rotated.

4. The game apparatus of claim 3 wherein the cylindrical wall of said drum includes a plurality of said at least one pocket equally spaced about the drum for carrying a plurality of said at least one card sequentially past said aperture.

5. The game apparatus of claim 4 including stop means operatively associated between the base and the rotatable drum to limit the rotation of the drum to approximately 360°.

6. The game apparatus of claim 5 further including a drive means for moving said card carrying means, and said stop means includes selectively actuatable locking means to preset said rotatable drum to a predetermined position prior to rotation by said drive means.

7. The game apparatus of claim 1 including a player identification card which carries indicia thereon associated with players of the game to dictate the order of which players of the game will be positioned for viewing the cards in the display means and to whom that player will attempt to convey the message, in variables of the number of players playing the game.

* * * * *